US006806791B1

(12) United States Patent
Wang et al.

(10) Patent No.: US 6,806,791 B1
(45) Date of Patent: Oct. 19, 2004

(54) TUNABLE MICROWAVE MULTIPLEXER

(75) Inventors: Chi Wang, Middletown, NJ (US); William Deppen Blair, Lanoka Harbor, NJ (US)

(73) Assignee: Radio Frequency Systems, Inc., Marlboro, NJ (US)

( * ) Notice: Subject to any disclaimer, the term of this patent is extended or adjusted under 35 U.S.C. 154(b) by 0 days.

(21) Appl. No.: 09/514,879

(22) Filed: Feb. 29, 2000

(51) Int. Cl.[7] ..... H01P 1/20; H01P 5/12

(52) U.S. Cl. ..... 333/134; 333/202; 333/206; 333/230

(58) Field of Search ..... 333/134, 202, 333/206, 230

(56) References Cited

U.S. PATENT DOCUMENTS

| | | | | |
|---|---|---|---|---|
| 4,091,344 A | | 5/1978 | LaTourrette | |
| 4,241,322 A | | 12/1980 | Johnson et al. | |
| 4,450,421 A | | 5/1984 | Meguro et al. | |
| 4,567,454 A | * | 1/1986 | Saito | 333/206 |
| 4,777,459 A | | 10/1988 | Hudspeth | |
| 4,799,033 A | | 1/1989 | Igarashi et al. | |
| 4,862,122 A | | 8/1989 | Blair et al. | |
| 5,130,683 A | | 7/1992 | Agahi-Kesheh | |
| 5,229,729 A | | 7/1993 | Nishikawa et al. | |
| 5,329,687 A | | 7/1994 | Scott et al. | |
| 5,373,270 A | | 12/1994 | Blair et al. | |
| 5,412,359 A | | 5/1995 | Kazama et al. | |
| 5,418,509 A | * | 5/1995 | Piirainen | 333/203 |
| 5,428,322 A | | 6/1995 | Hendrick et al. | |
| 5,428,325 A | | 6/1995 | Jachowski et al. | |
| 5,684,438 A | | 11/1997 | D'Oro | |
| 5,804,534 A | * | 9/1998 | Zaki | 505/210 |
| 5,841,330 A | | 11/1998 | Wenzel et al. | |
| 5,894,250 A | | 4/1999 | Ravaska et al. | |
| 5,936,490 A | | 8/1999 | Hershtig | |
| 5,949,309 A | | 9/1999 | Correa | |
| 5,990,767 A | | 11/1999 | Ivanov et al. | |
| 5,991,607 A | * | 11/1999 | Burdenski et al. | 455/83 |
| 6,215,376 B1 | * | 4/2001 | Hagstrom et al. | 333/203 |
| 6,392,506 B2 | * | 5/2002 | Wulff | 333/134 |
| 6,600,394 B1 | * | 7/2003 | Wang et al. | 333/235 |

OTHER PUBLICATIONS

61/169191.*
60/155600.*

* cited by examiner

*Primary Examiner*—Benny Lee
*Assistant Examiner*—Kimberly Glenn
(74) *Attorney, Agent, or Firm*—Sughrue Mion, PLLC

(57) ABSTRACT

The invention is related to the field of tunable multiplexers. It consists of a tunable microwave multiplexer comprising a plurality of channel filters coupled to a combining/dividing mechanism. The plurality of channel filters can be either dielectric loaded resonators or combline resonators, while the combining/dividing mechanism can be a common resonator. In one embodiment, the common resonator is a multiple half-wavelength coaxial resonator.

52 Claims, 5 Drawing Sheets

TUNABLE MICROWAVE MULTIPLEXER

FIELD OF THE INVENTION

The invention is related to the field of tunable multiplexers. More particularly, this invention relates to a tunable multiplexer which can effectively couple ceramic or metallic resonator filters with TEM resonator filters. The multiplexer provides contiguous channel spacing and wide resonant frequency band tuning.

BACKGROUND OF THE INVENTION

Multiplexers are used to combine a plurality of channels, each centered at a different frequency, into one combined signal. The same multiplexer can be used to separate a single signal carrying many frequencies or channels into the constituent channels, each channel located at its respective frequency.

In the prior art, multiplexers have been designed by connecting bandpass filters in parallel or series to combine the plurality of channels. Relatively simple decoupling techniques work to separate the constituent channels provided that the channels are separated by frequency spacings equivalent to several passbands of the individual filters. However, when the channels of the multiplexer are too close in frequency, the interaction of the nearby channels will significantly degrade the performance of the multiplexer. Simple decoupling techniques prove ineffective at frequencies this close.

When the channels of the multiplexer are contiguous, the multiplexer should be designed as an integral unit. One method of achieving this is disclosed in the paper "A Technique for the Design of a Multiplexer Having Contiguous Channels[1]," hereby incorporated by reference. The channel filters are connected in parallel using high

[1]G. L. Matthaei and L. Young, "A Technique for the Design of Multiplexer Having Contiguous Channels," *IEEE Trans. Microwave Theory Tech.*, vol. MTT-12, pp. 88–93, January 1964. impedance coupling wire. In addition, a susceptance-anulling network using a low-impedance line added at the common port results in a nearly constant total input admittance. However, it is very difficult to design and manufacture the coupling wires needed to achieve the required couplings and low imaginary impedance over all channels or frequency bands at the common port.

The paper "A Generalized Multiplexer Theory[2]," hereby incorporated by reference, discloses the use of a common transformer to produce planar structure duplexers, star shaped combline filters and interdigital multiplexers. However, this method is limited to use with TEM resonator structures.

[2]J. D. Rhodes ad R. Levy, *IEEE Trans. Microwave Theory Tech.*, vol. MTT-27, pp. 111–123, February 1979.

U.S. Pat. No. 5,262,742, hereby incorporated by reference, discloses a half wavelength transmission line used as a common resonator or common transformer. The common resonator is used to couple two combline filters to a common antenna port. However, like the method disclosed in "A Generalized Multiplexer Theory," this method is limited to use with TEM resonator structures.

SUMMARY OF THE INVENTION

Referring now to the figures, in which like numerals refer to like elements, the present invention is shown. The invention comprises a tunable microwave multiplexer. Within the multiplexer is a plurality of channel filters comprising at least one resonator for filtering microwave and RF signals. The channel filters are coupled to a combining/dividing mechanism. The combining/dividing mechanism comprises a common port and a common resonator coupled to the common port.

In another embodiment, the invention comprises a microwave communication system comprising a receiver for receiving RF and microwave signals, a transmitter for transmitting RF and microwave signals, a signal processor coupled to the receiver and transmitter for processing signals and at least one antenna coupled to the receiver and the transmitter. Either the receiver or the transmitter can comprise a tunable microwave multiplexer. The tunable microwave multiplexer comprises a plurality of channel filters comprising at least one resonator for filtering RF and microwave signals. In addition, the multiplexer contains a combining/dividing mechanism coupled to the plurality of channel filters via coupling apertures. The combining/dividing mechanism comprises a common port and a multiple half-wavelength coaxial resonator coupled to the common port. In addition, the tunable microwave multiplexer contains transmission ports coupled to the plurality of filters.

In still another embodiment, the invention comprises a method of multiplexing a plurality of microwave channel frequencies. This method includes the steps of inputting a signal comprising a plurality of frequency channels into a common resonator. In addition, the phase difference between a common port of a common resonator to each RF port of a plurality of cavity channel filters is maintained at approximately 0 or 180 degrees. Furthermore, the signal comprising a plurality of frequency channels is separated into its constituent frequency signals. Still furthermore, at least one of said plurality of frequency channels is output.

DETAILED DESCRIPTION OF ONE EMBODIMENT OF THE INVENTION

Figure 1:
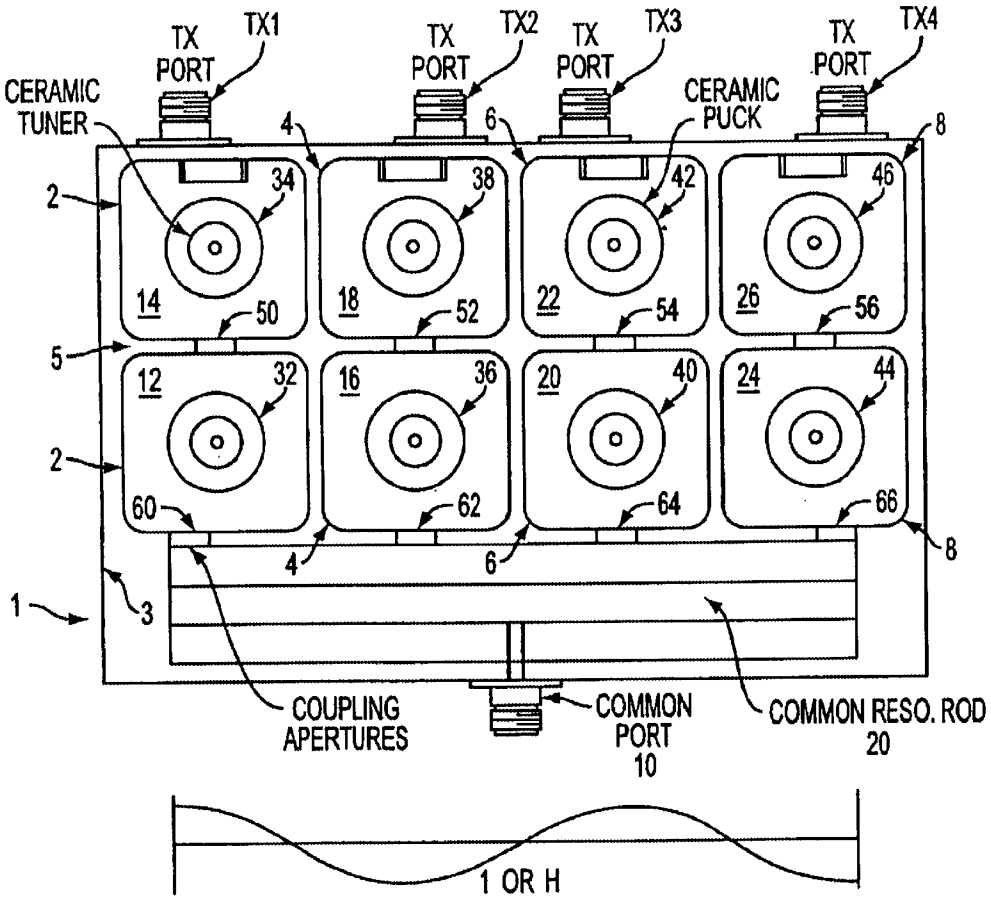
FIG. 1 is a configuration of a 4-channel tunable multiplexer, according to one embodiment of the present invention.

Referring now to the figures, in which like numerals refer to like elements, the present invention is shown. The present invention consists of a tunable microwave multiplexer 1 comprising a plurality of channel filters 2–8 coupled to a combining/dividing mechanism. In a preferred embodiment, the plurality of channel filters 2–8 can be either dielectric loaded resonators or combline resonators, while the combining/dividing mechanism is preferably a common resonator 20.

The tunable microwave multiplexer 1 can be used in a microwave communication system that both receives and transmits RF and microwave signals. The tunable microwave multiplexer can be used to both multiplex and demultiplex RF and microwave signals. An example of a microwave communication system that can be used is found in U.S. Pat. No. 4,578,815, hereby incorporated by reference.

The tunable multiplexer 1 operates in the following manner. A signal comprising a plurality of microwave signal frequencies is input at a common port 10. The signal will pass through the common resonator 20. A signal frequency from one of the plurality of microwave signals will couple into a filter 2–8 if the passband of the filter is tuned to the frequency of the microwave signal. On the other hand, if the passband of the filter is tuned to a different frequency, then the filter 2–8 will reject the microwave signal. In this manner, the plurality of microwave signals will be separated.

The tunable multiplexer 1 can also be used to combine signals of different frequencies. Signals of different frequencies are input via transmission ports to a channel filter 2–8 that will pass its respective frequency. The signals will be combined into one signal comprising these different signal frequencies in the common resonator 20. The composite signal is then output through the common port 20.

Multiplexer

The tunable microwave multiplexer 1 has a common port 10 into which a signal comprising a plurality of microwave signal frequencies is input. In a preferred embodiment, the common port 10 can be a single coaxial cable connector (see FIG. 1). The common port 10 can be coupled to the common resonator 20 using a tapped-in or loop configuration.

Use of a common resonator combining/dividing structure for the multiplexer 1 can maintain the phase difference of the RF signal from the common port 10 of the common resonator 20 to each RF port of the cavity channel filters 2–8 at precisely 0 or 180 degrees. Thus, there is no phase difference or displacement where the channel filters 2–8 interface with the common resonator 20. Therefore, no critical phasing transmission line is needed in the multiplexer 1. As a result, microwave channel frequencies can be combined or divided efficiently over a broad bandwidth.

Half-wavelength Coaxial Resonator

In a preferred embodiment, the common resonator is a multiple half-wavelength coaxial resonator 20 (see FIG. 1). The coaxial resonator's length is a multiple half-wavelength of the average frequency of the multiplexer 1. Stated another way, the physical length of the coaxial resonator 20 is a multiple half-wavelength of the average frequency of the input signal comprising a plurality of microwave signal frequencies input at common port 10. Therefore, the coaxial resonator 20 appears as a low impedance to any of the input channel frequencies.

The coaxial resonator 20 is operated at a higher order TEM mode. Thus, either the magnetic field or the electric current is a maximum at both ends of the resonator 20. In addition, there is a quarter wavelength difference in phase between the electric and the magnetic fields. Consequently, when the magnetic field is a minimum, the electric field is a maximum and vica-versa.

Figure 2:
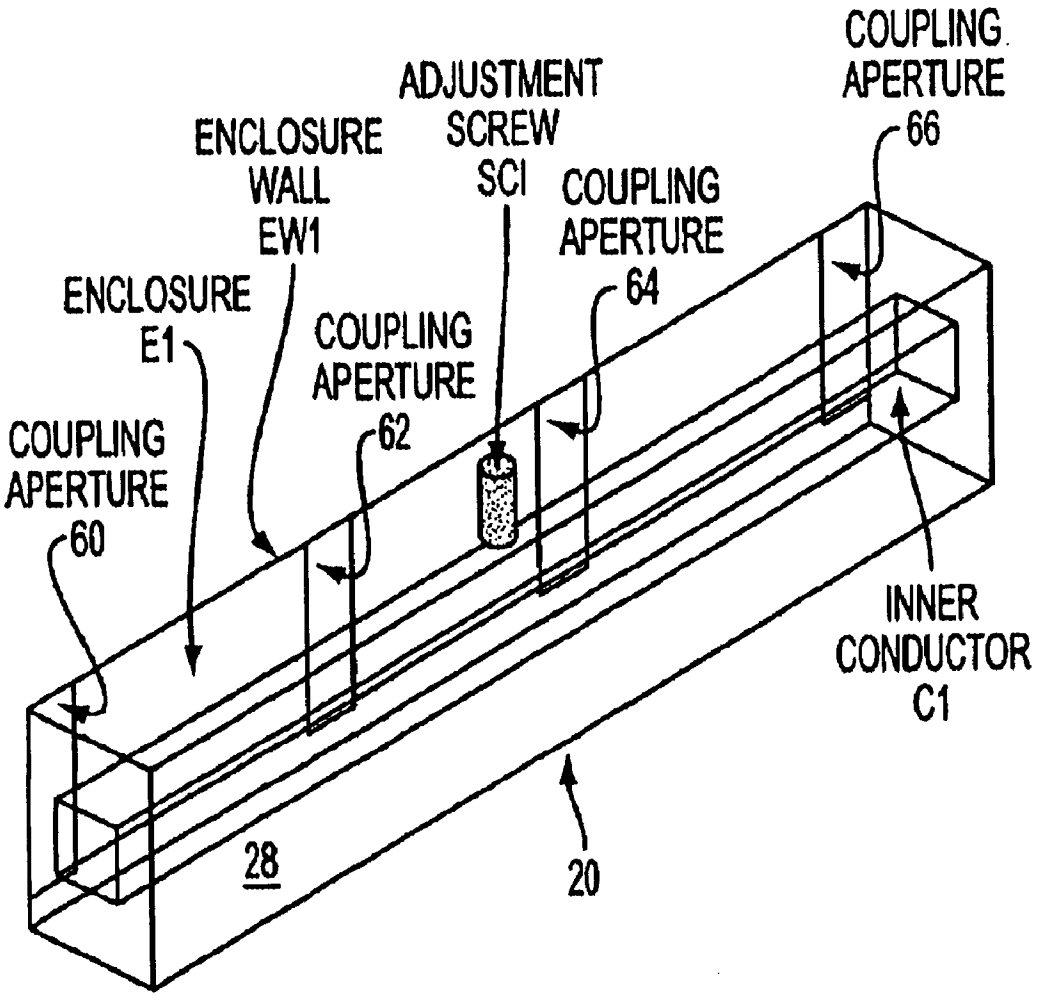
FIG. 2 is a configuration of a common resonator, according to one embodiment of the present invention.

An adjustment screw SC1 (accessible from the outside of the enclosure of the coaxial resonator 20) is used to adjust the resonant frequency of the coaxial resonator 20 (see FIG. 2). It is positioned where the electric field is a maximum in the coaxial resonator 20. By changing the resonant frequency of the coaxial resonator 20, a new center frequency is selected.

In a preferred embodiment, the coaxial resonator 20 comprises an enclosure E1, a cavity 28 and an inner conductor C1 (see FIG. 2). The inner conductor C1 is either milled into the resonator cavity 28 or affixed into the cavity 28 using the same conductive material as that used for the resonator's 20 enclosure E1. This ensures that the conductive material maintains good contact over temperature.

Both the magnetic and the electric fields vary periodically every half-wavelength along the half-wavelength coaxial resonator 20. Thus, there are multiple maximum magnetic field positions distributed along the resonator 20. Coupling apertures 60, 62, 64 and 66 (see FIG. 1 and FIG. 2) located on the enclosure wall EW1 of the common resonator 20, are positioned at the peaks of the magnetic field respectively. The signal input to the common port 10 is radiated through these coupling apertures 60–66. In a preferred embodiment, four channel filters 2, 4, 6 and 8 (see FIG. 1) are coupled to the coupling apertures 60 through 66 of the coaxial resonator 20 respectively. This allows for efficient coupling of the channel filters to the common port 10 of the multiplexer/demultiplexer 1 and optimized compactness of the housing.

Channel Filters

In a preferred embodiment, the plurality of channel filters 2–8 can consist of either dielectric loaded resonators or combline resonators. In a preferred embodiment, the dielectric loaded resonators can be made from a ceramic material. In another preferred embodiment, the combline resonators can be made from a ceramic material. In still another preferred embodiment, the combline resonators can be metallic resonators.

FIG. 1 discloses a preferred embodiment of the tunable microwave multiplexer/demultiplexer 1 that contains four filters 2, 4, 6 and 8, connected in parallel. In a preferred embodiment, each channel filter comprises two resonators, 32, 34, 36, 38, 40, 42, 44 and 46 (for a total of eight resonators) which are located in two cavities, 12, 14, 16, 18, 20, 22, 24 and 26 (for a total of eight cavities), respectively. For example, to filter 2 comprises resonators 32 and 34 located in cavities 12 and 14 respectively. The two resonators 32 and 34 are connected in series.

Figure 3:
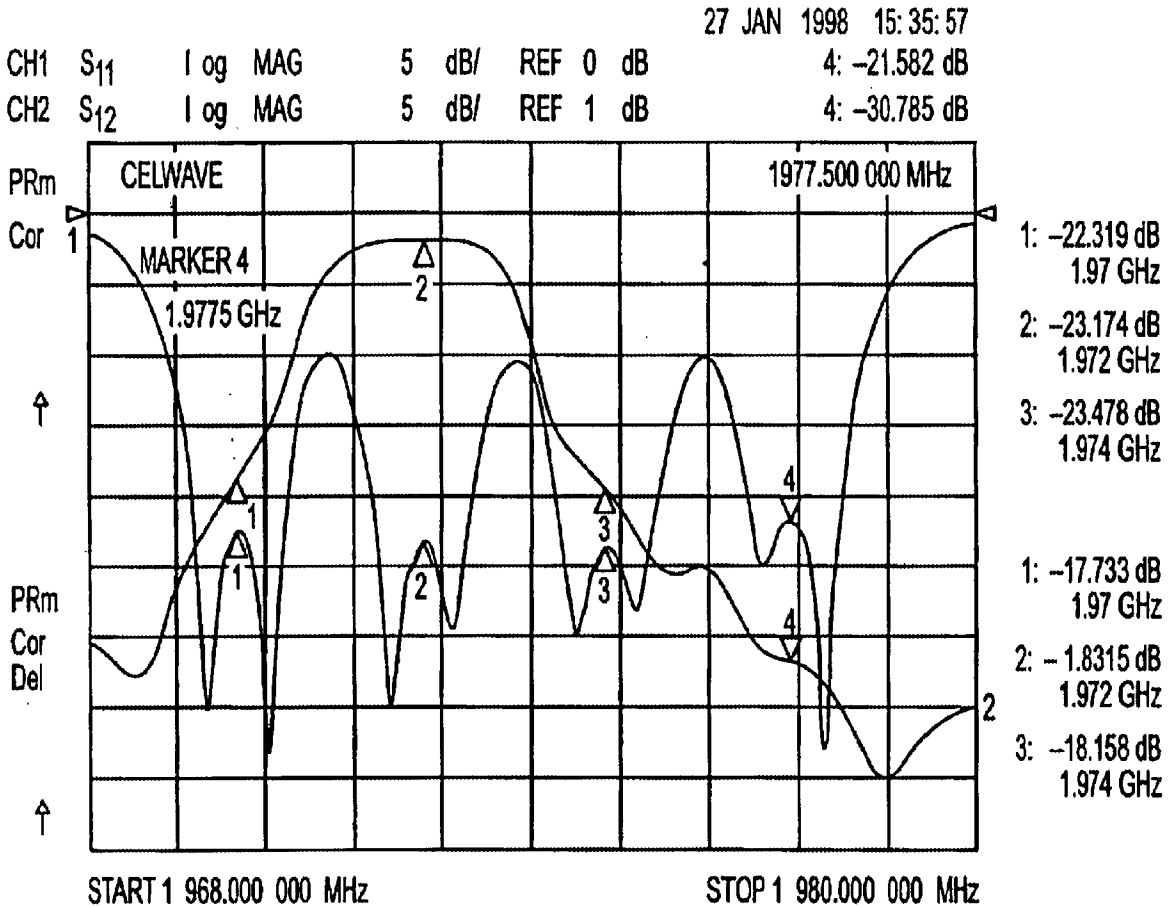
FIG. 3 is a measured frequency response of a 4-channel tunable multiplexer, according to one embodiment of the present invention.

The individual resonators 32–46 may be regarded as filter sections. An increase in the number of resonators 32–46 (or filter sections) connected in series produces a steeper skirt on the passband of the respective filter 2–8 which results in sharper attenuation of undesired frequencies. It should be noted that while four filters 2–8 containing two resonators 32–46 are shown, any number and combination of filters and resonators may also be used in accordance with what the specification discloses. FIG. 3 is an exemplary plot of the measured frequency response of a 4-channel tunable multiplexer 1.

Figure 4:
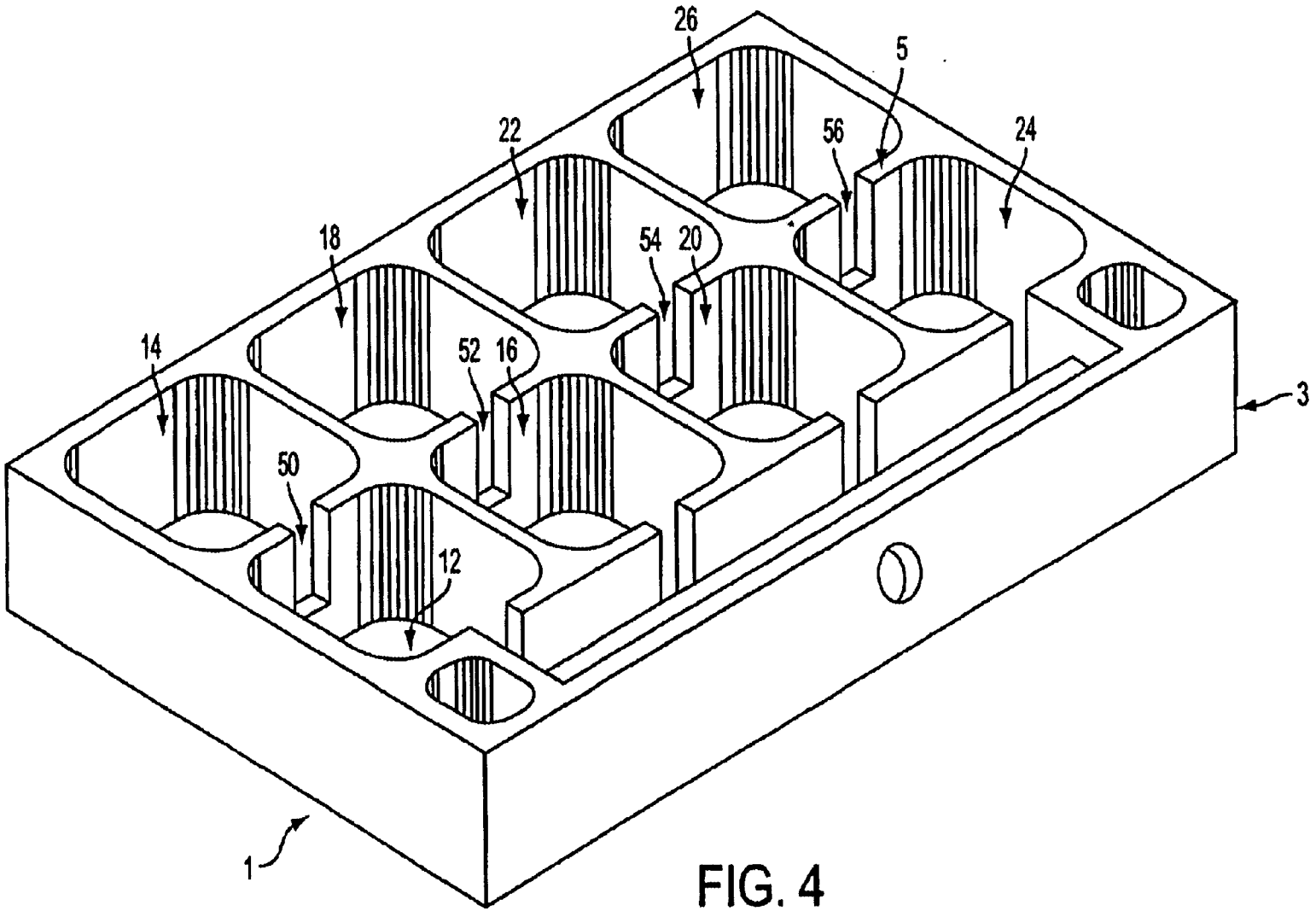
FIG. 4 is drawing of the tunable multiplexer housing, according to one embodiment of the present invention.

The cavities 12–26 are located within a housing 3 (see FIG. 1 and FIG. 4). In a preferred embodiment, the housing 3 is made from a conductive material such as aluminum, although other metals will also work well. In addition, a common enclosure wall 5 separates the cavities 12 through 26. FIG. 1 shows that the two resonators 32–46 of each channel filter, 2, 4, 6 and 8, are coupled together by apertures 50, 52, 54 and 56 respectively, opened on the common enclosure wall 5 between the two resonators.

In a preferred embodiment, the dielectric resonator used is disclosed in copending U.S. patent application Ser. No. 60/155,600, Tunable, Temperature Stable Dielectric Loaded Cavity Resonator and Filter, hereby incorporated by reference. In a preferred embodiment, the filters are tunable. A tuning element assembly can be used to adjust the frequency.

As stated above, the amount of coupling between the channel filters 2–8 and the common port 10 of the multiplexer 1 is controlled by the size and the location of the coupling apertures, 60 through 66. Energy from the multiple half-wavelength coaxial resonator 20 is coupled through the coupling apertures 60 through 66 and into the filters (2, 4, 6 and 8 respectively) via the filter resonator 32–44 connected to that aperture 60–66, respectively. The other end of each filter not connected to the coupling apertures is connected to a transmission port. Transmission ports TX1 through TX4 are connected to filters 2, 4, 6 and 8 respectively (see FIG. 1). In a preferred embodiment, transmission ports TX1 through TX4 can each be a single coaxial cable connector (see FIG. 1). Each transmission port TX1–TX4 can be used to output one of the channel frequencies separated by the tunable multiplexer 1. In addition, it can be used as an input to receive a single channel frequency which will be combined in coaxial resonator 20 with other received channel frequencies from other transmission ports TX1–TX4 and output through common port 10.

Circuit Diagram

Figure 5:
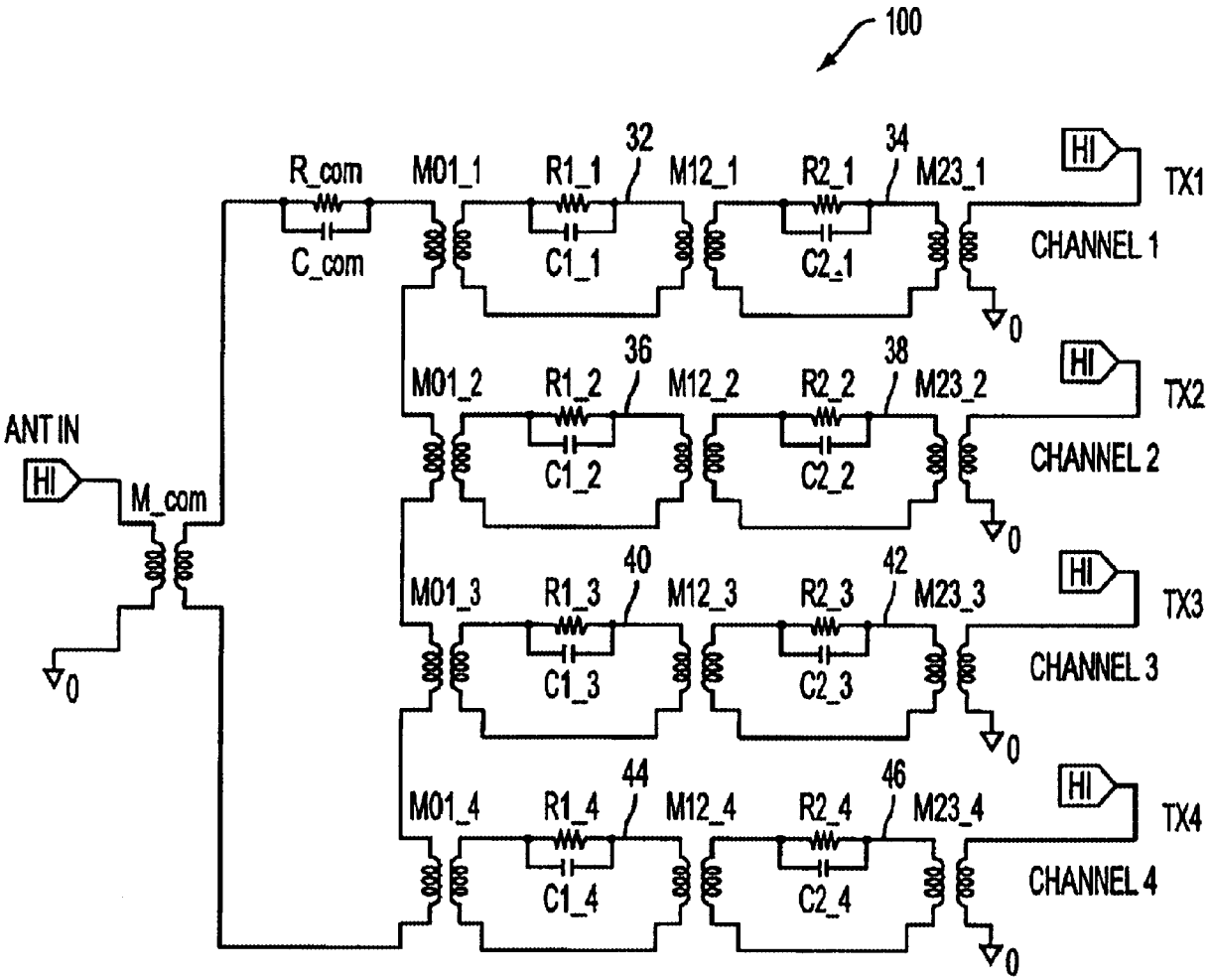
FIG. 5 is a circuit diagram of a 4-channel tunable multiplexer using a common resonator, according to one embodiment of the present invention.

FIG. 5 is a circuit diagram of a 4-channel tunable multiplexer 1, according to one embodiment of the present invention. Electrical circuit 100 illustrates schematically the circuit formed by the half-wavelength common resonator 20 and four channel filters 2–8 of FIG. 1. Transformer M_com represents common port 10. Transformers M01_1 through M01_4 represent the coupling apertures 60–66 located on the enclosure walls E1 of the common resonator 20. Transformers M12_1 through M12_4 represent apertures 50–56 opened on the common enclosure wall between the two resonators through which the two resonators of each channel filter 2–8 are coupled together, respectively. Transformers M23_1 to M23_4 represent transmitting ports TX1 through TX4, respectively.

Parallel RC circuits R_com and C_com represent the equivalent electrical circuit for the common resonator 20. Parallel RC circuits R1_1 and C1_1 through R2_4 and C2_4 represent the equivalent electrical circuits for resonators 32 through 46. Each resonator is tuned to resonate at the frequency meant to be passed by its associated filter. Therefore, it will have a minimum impedance at that frequency. Both contiguous and noncontiguous channel filters 2–8 can be multiplexed/demultiplexed by adjusting the common resonator 20 and channel filter frequencies respectively.

While the invention has been disclosed in this patent application by reference to the details of preferred embodiments of the invention, it is to be understood that the disclosure is intended in an illustrative, rather than a limiting sense, as it is contemplated that modifications will readily occur to those skilled in the art, within the spirit of the invention and the scope of the appended claims and their equivalents.

What is claimed is:

1. A tunable microwave multiplexer, comprising:

a plurality of channel filters comprising at least one resonator; and a combining/dividing mechanism coupled to said plurality of channel filters comprising:

a common port; and a multiple half-wavelength common resonator coupled to said common port.

2. The tunable microwave multiplexer according to claim 1, wherein said at least one resonator is a combline resonator.

3. The tunable microwave multiplexer according to claim 1, wherein said at least one resonator is a dielectric loaded resonator.

4. The tunable microwave multiplexer according to claim 1, wherein said at least one resonator is a ceramic resonator.

5. The tunable microwave multiplexer according to claim 1, wherein said at least one resonator is a metallic resonator.

6. The tunable microwave multiplexer according to claim 1, further comprising transmission ports coupled to said plurality of filters.

7. The tunable microwave multiplexer according to claim 1, wherein at least one of said plurality of said channel filters comprises more than one filter section.

8. The tunable microwave multiplexer according to claim 7, wherein said more than one filter section is connected in series with at least one other filter section.

9. The tunable microwave multiplexer according to claim 1, wherein said at least one resonator comprises a tuning element assembly, whereby a resonant frequency can be adjusted.

10. The tunable microwave multiplexer according to claim 1, wherein said common resonator is a coaxial resonator.

11. The tunable microwave multiplexer according to claim 1, wherein said common port is coupled to said common resonator using a tapped-in or loop configuration.

12. The tunable microwave multiplexer according to claim 1, wherein said common resonator further comprises coupling apertures, wherein said plurality of channel filters is coupled to said plurality of coupling apertures.

13. The tunable microwave multiplexer according to claim 12, wherein said coupling apertures are positioned at peaks of a magnetic field.

14. The tunable microwave multiplexer according to claim 1, wherein said common resonator comprises an adjustment screw, whereby said adjustment screw is used to adjust the resonant frequency of said common resonator.

15. The tunable microwave multiplexer according to claim 14, wherein said adjustment screw is positioned where the electric field is a maximum in said common resonator.

16. The tunable microwave multiplexer according to claim 1, wherein said common resonator comprises:

an enclosure;

a cavity positioned inside said enclosure; and an inner conductor positioned in said cavity.

17. The tunable microwave multiplexer according to claim 16, wherein said inner conductor is milled into said cavity.

18. The tunable microwave multiplexer according to claim 16, wherein said inner conductor is affixed into said cavity.

19. The tunable microwave multiplexer according to claim 16, wherein said inner conductor is made using the same conductive material as that used for the common resonator's enclosure.

20. The tunable microwave multiplexer according to claim 1, wherein said more than one resonator is connected in series with at least one other resonator.

21. A tunable microwave multiplexer, comprising:

a plurality of channel filters comprising at least one resonator; and a combining/dividing mechanism coupled to said plurality of channel filters via coupling apertures, comprising:

a common port, and a multiple half-wavelength coaxial resonator coupled to said common port; and transmission ports coupled to said plurality of filters.

22. The tunable microwave multiplexer according to claim 21, wherein said coupling apertures located on said enclosure wall of said common resonator are positioned at peaks of a magnetic field.

23. The tunable microwave multiplexer according to claim 21, wherein said common port is coupled to said common resonator using a tapped-in or loop configuration.

24. The tunable microwave multiplexer according to claim 21, wherein said at least one resonator is a combline resonator.

25. The tunable microwave multiplexer according to claim 21, wherein said at least one resonator is a dielectric loaded resonator.

26. The tunable microwave multiplexer according to claim 21, wherein said at least one resonator is a ceramic resonator.

27. The tunable microwave multiplexer according to claim 21, wherein said at least one resonator is a metallic resonator.

28. The tunable microwave multiplexer according to claim 21, wherein said at least one resonator comprises a tuning element assembly, whereby a resonant frequency can be adjusted.

29. The tunable microwave multiplexer according to claim 21, wherein said multiple half-wavelength coaxial resonator comprises: an enclosure;

a cavity positioned inside said enclosure; and an inner conductor positioned in said cavity.

30. The tunable microwave multiplexer according to claim 21, wherein said at least one resonator is connected in series with at least one other resonator.

31. The tunable microwave multiplexer according to claim 21, wherein said inner conductor is milled into said cavity.

32. The tunable microwave multiplexer according to claim 21, wherein said inner conductor is affixed into said cavity.

33. The tunable microwave multiplexer according to claim 21, wherein said multiple half-wavelength coaxial resonator comprises an adjustment screw, whereby said adjustment screw is used to adjust the resonant frequency of said multiple half-wavelength coaxial resonator, wherein said adjustment screw is positioned where the electric field is a maximum in said common resonator.

34. A microwave communication system, comprising: a receiver;

a signal processor coupled to said receiver; and at least one antenna coupled to said receiver;

wherein said receiver comprises at least one tunable microwave multiplexer, comprising:

a plurality of channel filters comprising at least one resonator; and a combining/dividing mechanism coupled to said plurality of channel, comprising:

a common port, and a multiple half-wavelength coaxial resonator coupled to said common port; and transmission ports coupled to said plurality of filters.

35. The tunable microwave multiplexer according to claim 34, further comprising coupling apertures coupling said combining/dividing mechanism and said plurality of channel filters, wherein said coupling apertures are located on said enclosure wall of said common resonator, positioned at peaks of a magnetic field.

36. The tunable microwave multiplexer according to claim 34, wherein said common port is coupled to said common resonator using a tapped-in or loop configuration.

37. The tunable microwave multiplexer according to claim 34, wherein said at least one resonator comprises a tuning element assembly, whereby a resonant frequency can be adjusted.

38. The tunable microwave multiplexer according to claim 34, wherein said multiple half-wavelength coaxial resonator comprises: an enclosure;

a cavity positioned inside said enclosure; and an inner conductor positioned in said cavity.

39. The tunable microwave multiplexer according to claim 34, wherein said at least one resonator is connector series with at least one other resonator.

40. The tunable microwave multiplexer according to claim 34, wherein said multiple half-wavelength coaxial resonator comprises an adjustment screw, whereby said adjustment screw is used to adjust the resonant frequency of said common resonator, wherein said adjustment screw is positioned where the electric field is a maximum in said common resonator.

41. A microwave communication system, comprising: a transmitter;

a signal processor coupled to said transmitter; and at least one antenna coupled to said transmitter;

wherein said transmitter comprises at least one tunable microwave multiplexer, comprising:

a plurality of channel filters comprising at least one resonator; and a combining/dividing mechanism coupled to said plurality of channel filters, comprising:

a common port, and a multiple half-wavelength coaxial resonator coupled to said common port; and transmission ports coupled to said plurality of filters.

42. The tunable microwave multiplexer according to claim 41, further comprising coupling apertures for coupling said combining/dividing mechanism and said plurality of channel filters, wherein said coupling apertures are located on said enclosure wall of said common resonator, positioned at peaks of a magnetic field.

43. The tunable microwave multiplexer according to claim 41, wherein said common port is coupled to said common resonator using a tapped-in or loop configuration.

44. The tunable microwave multiplexer according to claim 41, wherein said at least one resonator comprises a tuning element assembly, whereby a resonant frequency can be adjusted.

45. The tunable microwave multiplexer according to claim 41, wherein said multiple half-wavelength coaxial resonator comprises: an enclosure;

a cavity positioned inside said enclosure; and an inner conductor positioned in said cavity.

46. The tunable microwave multiplexer according to claim 41, wherein said at least one resonator is connected in series with at least one other resonator.

47. The tunable microwave multiplexer according to claim 41, wherein said multiple half-wavelength coaxial resonator comprises an adjustment screw, whereby said adjustment screw is used to adjust the resonant frequency of said common resonator, wherein said adjustment screw is positioned where the electric field is a maximum in said common resonator.

48. A method of multiplexing a plurality microwave channel frequencies, comprising:

inputting a signal comprising a plurality of frequency channels into a common resonator;

maintaining the phase difference between a common port of a common resonator to each RF port of a plurality of cavity channel filters at approximately 0 or 180 degrees;

separating said signal comprising a plurality of frequency channels; and outputting at least one of said plurality of frequency channels.

49. The method of multiplexing microwave channel frequencies according to claim 48, wherein said step of separating said signal, comprises:

coupling said signal comprising a plurality of frequency channels at peaks of a magnetic field within said common resonator to a plurality of channel filters; and filtering the frequency channels of said signal using said plurality of channel filters.

50. The method of multiplexing channel frequencies according to claim 48, further comprising the step of adjusting the resonant frequency of said common resonator.

51. The method of multiplexing channel frequencies according to claim 48, further comprising the step of adjusting the resonant frequency of one of said plurality of frequency channels.

52. The method of multiplexing channel frequencies according to claim 48, wherein said common resonator is a multiple half-wave coaxial resonator.

* * * * *